United States Patent [19]

Minegishi et al.

[11] 4,038,196

[45] July 26, 1977

[54] SOFTENING AGENT FOR WOVEN FABRICS

[75] Inventors: Yutaka Minegishi, Saitama; Haruhiko Arai, Narashino, both of Japan

[73] Assignee: Kao Soap Co., Ltd., Tokyo, Japan

[21] Appl. No.: 616,621

[22] Filed: Sept. 25, 1975

[30] Foreign Application Priority Data

Mar. 12, 1975 Japan ..... 50-29768

[51] Int. Cl.[2] ..... D06M 11/04; D06M 13/36; D06M 13/46

[52] U.S. Cl. ..... 252/8.8; 252/8.9; 252/546; 252/547

[58] Field of Search ..... 252/8.8, 8.9, 546, 547

[56] References Cited

U.S. PATENT DOCUMENTS

| | | | |
|---|---|---|---|
| 3,364,142 | 1/1968 | Buck | 252/8.8 |
| 3,850,818 | 11/1974 | Katsumi et al. | 252/8.8 |
| 3,862,045 | 1/1975 | Sato et al. | 252/8.75 |
| 3,904,533 | 9/1975 | Neiditch et al. | 252/8.8 |

*Primary Examiner*—John Kight, III

*Attorney, Agent, or Firm*—Blanchard, Flynn, Thiel, Boutell & Tanis

[57] ABSTRACT

A softening agent for woven fabrics consisting essentially of 3 to 20 weight % of a quaternary ammonium salt having the formula

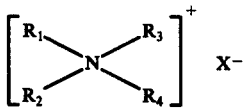

wherein $R_1$ and $R_2$ are a long chain alkyl group or long chain $\beta$-hydroxyalkyl group, $R_3$ and $R_4$ are alkyl group, hydroxyalkyl group, benzyl group or a group $-(C_2H_4O)_nH$, X is a halogen or a monoalkyl sulfuric acid group, 0.2 to 5% of a polyoxyethyleneoleyl ether having an ethylene oxide average addition mole number of 8 to 200, 0.5 to 10% of urea, and 0.08 to 2% of a water-soluble ammonium salt.

3 Claims, No Drawings

SOFTENING AGENT FOR WOVEN FABRICS

BACKGROUND OF INVENTION

1. Field of Invention

The present invention is concerned with a liquid softening agent for woven fabrics, having excellent stability.

2. DESCRIPTION OF PRIOR ART

Most of the softening agents marketed for household uses are in the form of a liquid composition. The quaternary ammonium salt in the composition possesses two long-chain alkyl groups or β-hydroxyalkyl groups showing an affinity to the water, but a low degree of solubility in water. Therefore, the aqueous solutions having high concentrations of the quaternary ammonium salt are transferred into gels, thus making it hard to obtain a stable composition of a low viscosity. Therefore, a variety of methods have been attempted in order to obtain low viscosity and stable liquid compositions, for example by adding a non-ionic surface active agent, monoalkyl cationic surface active agent, solvent, etc.

For example, Japanese Patent Publication No. 3920/70 discloses a liquid softening agent for woven fabrics composed of a quaternary ammonium salt, a non-ionic surface active agent consisting of an ethylene oxide addition product a higher alcohol, a higher aliphatic acid or alkylphenol, and a solvent such as a lower alcohol, glycerol, glycol, etc. The Japanese Laid-open Patent Application No. 54300/73 proposes to blend an alkyl polyoxyethylenated quaternary ammonium salt or alkyl-betaine to the aforesaid composition to make a softening composition for the purpose of increasing the solution stability and imparting an antistatic property. However, the blend compositions recited in the claims of the above publication and application do not obtain a stable liquid composition, unless there are made present alkali metal salts such as sodium chloride as disclosed in the specification of the present application. Without containing such alkali metal salts, the liquid composition tends to be gelled, making it hard to obtain a desired liquid composition. The blend systems in which there is incorporated alkali metal salts may help obtain a composition having a low viscosity and improved recovery from freezing, but they do not form stable dispersion systems. Therefore, according to such methods, it is necessary to incorporate large amounts of the aforementioned compounds such as non-ionic surface active agent or solvent for the purpose of giving satisfactory dispersion stability and recovery from freezing at any temperatures.

However, the aforesaid stabilizing effect, owing to its hydrotropy effects to the hydrophobic group, develops its effect during the treatment of the woven fabric; therefore, the quaternary ammonium salt is not absorbed sufficiently by the woven fabric, eventually, making it impossible to fully impart the softening effect to the woven fabric.

On the other hand, if the additives are incorporated in small amounts, the resulting composition which may have low viscosity at the time of the incorporation, will cause the dispersed particles to be agglomerated upon heating or freezing and gives rise to the occurrence of creaming or gellation.

SUMMARY OF INVENTION

In this way, there was no method until the advent of the present invention to stably incorporate the quaternary ammonium salt having two long-chain alkyl groups or long-chain β-hydroxyalkyl groups while maintaining low viscosity.

Therefore, the inventors of the present invention have conducted extensive study in an effort to overcome the aforementioned deficiencies of the earlier liquid softening agents, and have found the fact that the use of the quaternary ammonium salt in combination with a polyoxyethyleneoleyl ether, urea and water-soluble ammonium salt, makes it possible to obtain markedly improved dispersion stability and recovery from freezing without adversely affecting the softening property.

That is, the present invention provides a softening agent for woven fabrics consisting essentially of 3 to 20% of a quaternary ammonium salt (component A) represented by the following general formula

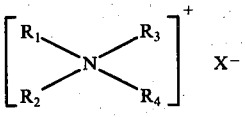

wherein $R_1$ and $R_2$ are each an alkyl group having 12 to 20 carbon atoms, or β-hydroxyalkyl group having 14 to 22 carbon atoms, $R_3$ and $R_4$ are each any one of alkyl group having 1 to 3 carbon atoms, hydroxyalkyl group, benzyl group or a group $-(C_2H_4O)_nH$ (in which $n$ is an integer of 1 to 3), X is a halogen atom or a monoalkyl sulfuric acid group having an alkyl group with 1 to 3 carbon atoms, 0.2 to 5% of a polyoxyethyleneoleyl ether having an ethylene oxide average addition mole number of 8 to 200 (component B), 0.5 to 10% of urea (component C), and 0.08 to 2% of a water-soluble ammonium salt (component D) composed of any one of ammonia, monoethanolamine, diethanolamine or triethanolamine and a mineral acid such as hydrochloric acid, nitric acid and sulfuric acid or a carboxylic acid such as acetic acid, hydroxyacetic acid and formic acid having 1 to 3 carbon atoms, wherein the incorporation ratios (weight basis) of the components are within the following ranges:

B/A = 0.06 to 0.7,
C/A = 0.1 to 1.3, and
D/A = 0.025 to 0.17.

Owing to its excellent softening action on the woven fabrics, the quaternary ammonium salt having two long-chain alkyls or β-hydroxyalkyls in one molecule, is now largely occupying the position of a commercially available softening agent for household uses.

The quaternary ammonium salt, polyoxyethyleneoleyl ether, urea and water-soluble ammonium salt may, of course, be mixed together appropriately.

The effects resulting from the combination of polyoxyethyleneoleyl ether, urea and water-soluble ammonium salt according to the present invention are illustrated below by way of an Example.

Example

| Incorporated Composition: | | |
|---|---|---|
| Distearyldimethylammonium chloride | (A) | 6.0% by weight |
| Polyoxyethylene (p=100) oleyl ether | (B) | 0.24 - 5.40 |
| Urea | (C) | 0.48 - 9.00 |
| Ammonium chloride | (D) | 0.12 - 1.20 |

-continued

| | |
|---|---|
| Water | balance |

Note:
B/A = 0.04 - 0.9
C/A = 0.08 - 1.50
D/A = 0.020 - 0.200

Table 1 shows the relationship among the incorporation amount of polyoxyethylene ($\bar{p}=100$) oleyl ether, urea and ammonium chloride, viscosity, dispersion stability and recovery from freezing, based on the aforementioned incorporated composition.

The viscosity represents values (centipoise) measured at 25° C using a BM-type viscometer, the recovery from freezing was found from the average of testing conducted five times in which freezing of a specimen was effected at −15° C and melted by being left to stand at 30° C, and the dispersion stability was found from the presence or absence of the dispersed state by leaving a specimen in a vessel maintained at 50° C for 4 weeks.

As will be apparent from Table 1, it is possible to obtain a low-viscosity composition having excellent recovery from freezing and dispersion stability by appropriately incorporating the three components simultaneously, i.e., polyoxyethylene ($\bar{p}=100$) oleyl ether, urea and ammonium chloride into the distearyldimethylammonium chloride. A lack or an excess of even one of the aforesaid three components, causes one or both of the recovery from freezing and dispersion stability to be deteriorated.

On the other hand, as shown by the Controls, a softening agent having excellent recovery from freezing and dispersion stability is not obtained if a polyoxyethylene ($\bar{p}=100$) lauryl ether is used as a non-ionic activating agent of the present invention (Control (a)), if an ethylene glycol is used in place of urea (Control (b)), and if a non-ionic activating agent, monoalkyl ammonium, and solvent are used in combination (Controls (c) to (e)).

Table 1

| | D/A | Viscosity (cp) | | | | | Recovery from freezing | | | | | Dispersion stability | | | | |
|---|---|---|---|---|---|---|---|---|---|---|---|---|---|---|---|---|
| B/A | C/A | 0.020 | 0.025 | 0.10 | 0.17 | 0.20 | 0.020 | 0.025 | 0.10 | 0.17 | 0.20 | 0.020 | 0.025 | 0.10 | 0.17 | 0.20 |
| | 0.08 | gel | gel | 45 | 23 | 19 | — | — | X | Δ | Δ | — | — | X | X | X |
| | 0.10 | gel | — | 51 | — | 24 | — | — | Δ | — | Δ | — | — | X | — | X |
| 0.04 | 0.60 | gel | gel | 112 | 42 | 40 | — | — | X | Δ | Δ | — | — | Δ | X | Δ |
| | 1.30 | gel | — | 2760 | — | 910 | — | — | X | — | X | — | — | Δ | — | Δ |
| | 1.50 | gel | gel | gel | gel | gel | — | — | — | — | — | — | — | — | — | — |
| | 0.08 | gel | 1020 | 89 | 25 | 23 | — | X | X | X | Δ | — | ○ | Δ | X | X |
| | 0.10 | gel | 890 | 62 | 23 | 19 | — | Δ | ○ | ○ | Δ | — | ◎ | ○ | ○ | X |
| 0.06 | 0.60 | gel | 763 | 73 | 57 | 31 | — | ○ | ◎ | ○ | ○ | — | ◎ | ◎ | ○ | X |
| | 1.30 | gel | 601 | 88 | 79 | 66 | — | ○ | ○ | ○ | ○ | — | ○ | ○ | ○ | Δ |
| | 1.50 | gel | 577 | 101 | 96 | 90 | — | X | X | Δ | Δ | — | Δ | Δ | X | X |
| | 0.08 | 291 | 272 | 35 | 29 | 26 | X | X | Δ | Δ | Δ | ○ | Δ | X | X | X |
| | 0.10 | 235 | 201 | 30 | 26 | 20 | X | ○ | ○ | ○ | Δ | ○ | ○ | ○ | ○ | X |
| 0.3 | 0.60 | 193 | 185 | 36 | 28 | 25 | X | ○ | ◎ | ○ | ○ | ○ | ◎ | ◎ | ○ | Δ |
| | 1.30 | 176 | 170 | 42 | 32 | 29 | X | ○ | ○ | ○ | Δ | ○ | ◎ | ◎ | ○ | ○ |
| | 1.50 | 170 | 163 | 51 | 39 | 33 | X | Δ | Δ | Δ | X | ○ | ○ | ○ | Δ | Δ |
| | 0.08 | 214 | 202 | 82 | 71 | 65 | X | X | ○ | ○ | Δ | Δ | Δ | X | X | X |
| | 0.10 | 207 | 181 | 73 | 54 | 44 | X | ○ | ○ | ○ | ○ | ○ | ○ | ○ | ○ | X |
| 0.7 | 0.60 | 190 | 173 | 76 | 55 | 47 | Δ | ○ | ◎ | ○ | ○ | ◎ | ◎ | ◎ | ○ | Δ |
| | 1.30 | 203 | 192 | 81 | 60 | 52 | Δ | ○ | ○ | ○ | ○ | ◎ | ◎ | ◎ | ○ | ○ |
| | 1.50 | 229 | 204 | 94 | 65 | 63 | Δ | ○ | Δ | ○ | ○ | ○ | ○ | ○ | Δ | X |
| | 0.08 | 192 | 185 | 105 | 93 | 87 | X | X | X | Δ | Δ | ○ | ○ | Δ | X | X |
| | 0.10 | 201 | — | 99 | — | 89 | X | — | Δ | — | Δ | ○ | — | Δ | — | X |
| 0.9 | 0.60 | 222 | 211 | 106 | 91 | 90 | Δ | Δ | Δ | ○ | ○ | ○ | ○ | Δ | X | X |
| | 1.30 | 235 | — | 111 | — | 88 | Δ | — | Δ | — | ○ | ○ | — | ○ | — | X |
| | 1.50 | 238 | 230 | 127 | 91 | 85 | Δ | Δ | Δ | ○ | ○ | ○ | ○ | ○ | Δ | X |
| Control | a | | | 27 | | | | | X | | | | | ○ | | |
| | b | | | 93 | | | | | ○ | | | | | X | | |
| | c | | | gel | | | | | — | | | | | — | | |
| | d | | | 32 | | | | | ○ | | | | | X | | |
| | e | | | 50 | | | | | Δ | | | | | Δ | | |

Control:

| | | |
|---|---|---|
| (a) | Distearyldimethylammonium chloride | 6.0 |
| | Polyoxyethylene (p=100) lauryl ether | 1.0 |
| | Urea | 2.0 |
| | Ammonium chloride | 0.5 |
| | Water | balance |
| (b) | Distearyldimethylammonium chloride | 6.0 |
| | Polyoxyethylene (p=100) oleyl ether | 1.0 |
| | Ethylene glycol | 5.0 |
| | Ammonium chloride | 0.5 |
| | Water | balance |
| (c) | Distearyldimethylammonium chloride | 6.0 |
| | Polyoxyethylene (p=30) nonylphenyl ether | 1.0 |
| | Ethylene glycol | 5.0 |
| | Water | balance |
| (d) | Sodium chloride was incorporated in an amount of 0.07% to the Control (c). | |
| (e) | Distearyldimethylammonium chloride | 6.0 |
| | Stearylmethyldipolyoxyethylene (p=50) ammonium chloride | 2.0 |
| | Propylene glycol | 5.0 |
| | Water | balance |

Rating:
◎ very good ○: good Δ : poor X : very poor

In this way, incorporation of the three components, i.e., polyoxyethyleneoleyl ether, urea and ammonium salt into a quaternary ammonium salt, gives marked effects such as excellent recovery from freezing and dispersion stability of the quaternary ammonium salt.

The quaternary ammonium salt (A) having two long-chain alkyl groups or β-hydroxyalkyl groups that provides softening effects, according to the present invention, should be incorporated in an amount of 3% or more from the standpoint of household uses, and less than 20% from the standpoint of viscosity and preservation stability of the liquid composition.

Further, it is essential that the mixing ratios of the quaternary ammonium salt (A), polyoxyethyleneoleyl ether (B), urea (C) and ammonium salt (D) lie within the ranges of B/A = 0.06 - 0.7, C/A = 0.1 - 1.3, and D/A = 0.025 - 0.17, from the viewpoint of viscosity, preservation of stability and softness.

In practice, it is possible to incorporate an inorganic salt such as sodium chloride or polyoxyethylene saturated alkyl ether for the purpose of adjusting the viscosity, to add a pigment or a dyestuff for the purpose of appearance of the product, and to add perfumes to provide improved odor during the use and after the finishing.

The Examples are shown below, but it should be noted that the present invention is not limited thereto. Percentages are all on the weight basis in the Examples.

| | |
|---|---|
| Example 1 | |
| Distearyldimethylammonium chloride | 7% |
| Polyoxyethylene (p=130) oleyl ether | 1.5 |
| Urea | 2 |
| Ammonium chloride | 0.5 |
| Perfume, pigment | small amount |
| Water | balance |
| Example 2 | |
| Di-β-hydroxystearyldiethylammonium chloride | 20% |
| Polyoxyethylene (p=20) oleyl ether | 3 |
| Urea | 10 |
| Triethanolamine hydrochloride | 2 |
| Perfume, pigment | small amount |
| Water | balance |
| Example 3 | |
| Dilauryldipropylammonium bromide | 15% |
| polyoxyethylene (p=180) oleyl ether | 5 |
| Urea | 3% |
| Ammonium acetate | 0.5 |
| Perfume, pigment | small amount |
| Water | balance |
| Example 4 | |
| Dipalmitylmethylethylammonium ethyl sulfate | 3% |
| Polyoxyethylene (p=80) oleyl ether | 0.2 |
| Urea | 0.5 |
| Diethanolamine propionic acid salt | 0.1 |
| Perfume, pigment | small amount |
| Water | balance |
| Example 5 | |
| Diarachinyldihydroxyethylammonium chloride | 10% |
| Polyoxyethylene (p=100) oleyl ether | 2 |
| Urea | 3 |
| Ammonium chloride | 1 |
| Perfume, pigment | small amount |
| Water | balance |
| Example 6 | |
| Di-hydrogenated tallowalkyl dimethyl ammonium chloride | 6% |
| Polyoxyethylene (p=100) oleyl ether | 0.8 |
| Polyoxyethylene (p=100) lauryl ether | 0.2 |
| Urea | 2 |
| Ammonium chloride | 0.5 |
| Perfume, pigment | small amount |
| Water | balance |

Table 2 shows the results of change of viscosity and stability when the compositions of the Examples 1 - 6 are preserved, in comparison with the four examples in which a polyoxyethyleneoleyl ether is removed from the composition of the Example 1 (Control A), in which urea is removed (Control B), in which ammonium chloride is removed (Control C), and in which said three components are removed (Control D). The dispersion stability was found from the observation of dispersed state after the specimen was left to stand in a constant-temperature vessel maintained at 50° C for 4 weeks, the recovery from freezing was determined from the testing repeated 5 times by freezing the specimen at −15° C and melting the specimen by leaving it in an atmosphere of 30° C, and the viscosity was measured 1 day after the incorporation, after preserved at a low temperature and a high temperature, all measured at 25° C using a BM-type viscometer.

Table 2

| Example No. | Viscosity one day after the incorporation (cp) | Recovery from freezing | | Dispersion stability | |
|---|---|---|---|---|---|
| | | Viscosity (cp) | State | Viscosity (cp) | State |
| 1 | 65 | 71 | ◎ | 63 | ◎ |
| 2 | 152 | 267 | ○ | 137 | ○ |
| 3 | 233 | 310 | ○ | 211 | ◎ |
| 4 | 32 | 39 | ◎ | 28 | ○ |
| 5 | 76 | 82 | ○ | 74 | ○ |
| 6 | 48 | 53 | ◎ | 47 | ◎ |
| Control | | | | | |
| A | 88 | — | X | — | X |
| B | 73 | — | X | 66 | Δ |
| C | 579 | — | X | 523 | Δ |
| D | gel | — | — | — | — |

Rating:
◎: very good ○: good Δ : poor X : very poor

The above results apparently indicate the superiority of the composition of the present invention.

The embodiments of the invention in which an exclusive property or privilege is claimed are defined as follows:

1. A softening agent for woven fabrics consisting essentially of

A. from 3 to 20 weight percent of a quaternary ammonium salt having the formula

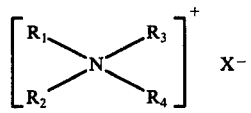

wherein $R_1$ and $R_2$ each is alkyl having 12 to 20 carbon atoms or β-hydroxyalkyl having 14 to 22 carbon atoms; $R_3$ and $R_4$ each is alkyl or hydroxyalkyl having 1 to 3 carbon atoms, benzyl or $-(C_2H_4O)_nH$, wherein $n$ is an integer of from one to 3; and X is halogen or alkyl sulfate in which alkyl has from one to 3 carbon atoms;

B. from 0.2 to 5 weight percent of polyoxyethyleneoleyl ether containing an average of from 8 to 200 moles of ethylene oxide;

C. from 0.5 to 10 weight percent of urea, and

D. from 0.08 to 2 weight percent of a water-soluble ammonium salt selected from the group consisting of the ammonia, monoethanolamine, diethanolamine and triethanolamine salts of mineral acids and carboxylic acids having one to 3 carbon atoms, and E. and the balance consists essentially of water, with the proviso that the weight ratios of A, B, C and D are as follows:

B/A = 0.06 to 0.7

C/A = 0.1 to 1.3, and

D/A = 0.025 to 0.17.

2. A softening agent as claimed in claim 1, in which said mineral acid is selected from the group consisting of hydrochloric acid, nitric acid and sulfuric acid.

3. A softening agent as claimed in claim 1, in which said carboxylic acid is selected from the group consisting of acetic acid, hydroxyacetic acid and formic acid.

* * * * *